United States Patent [19]

Mut

[11] 3,967,571

[45] July 6, 1976

[54] FOUR-POINT TUNNEL HULL FOR A BOAT

[76] Inventor: Melvin E. Mut, 5225 Adams Ave., Baton Rouge, La. 70806

[22] Filed: Mar. 13, 1975

[21] Appl. No.: 558,151

[52] U.S. Cl. ..... 114/66.5 S; 114/61

[51] Int. Cl.[2] ..... B63B 1/20

[58] Field of Search ..... 114/66.5 R, 66.5 S, 114/56, 61; 9/6

[56] References Cited

UNITED STATES PATENTS

| | | | |
|---|---|---|---|
| 1,712,281 | 5/1929 | Royer | 114/66.5 S |
| 3,126,856 | 3/1964 | Fuller | 114/66.5 S |
| 3,148,652 | 9/1964 | Canazzi | 114/66.5 S |

*Primary Examiner*—Stephen G. Kunin
*Assistant Examiner*—Sherman D. Basinger
*Attorney, Agent, or Firm*—Brisebois & Kruger

[57] ABSTRACT

Boat hull has two longitudinal downwardly projecting sponsons defining a tunnel therebetween. Each sponson is divided into two parts by a step. The front part slopes downwardly from the bow to the bottom of the step. The rear part slopes downwardly from the top of the step to the stern.

9 Claims, 12 Drawing Figures

FOUR-POINT TUNNEL HULL FOR A BOAT

SUMMARY OF THE INVENTION

This invention relates to a four-point tunnel hull for a boat.

It is common practice to so shape the bottoms of boats so that two longitudinally extending, downwardly projecting, laterally-spaced sponsons define therebetween a longitudinal channel extending from the bow to the stern of the boat and frequently are referred to as a "tunnel".

In such boats pressure builds up in the tunnel between the two sponsons, which can be released only at the stern of the boat. At high speeds, because of this pressure build-up, there is a tendency for the boat to ride up on the column of air pressure and then to fall off to either side, causing a "dig-in", "spin-out" or pass and flip backward.

In my novel hull a step is provided in each sponson intermediate the bow and stern. A portion of the pressure is relieved at these steps, so as to avoid the above dangers. The bottom of the front part of each sponson also lies at a sharper angle to the perpendicular than that of the rear part. The deep vee of the front part results in a smoother ride because of the improved entry into rough water. The flatter rear sponsons assist in carrying heavier loads under more stable conditions.

In order that the invention may be more fully understood, a preferred embodiment thereof will now be described, purely by way of illustration and example, with reference to the accompanying drawings, in which.

Figure 1:
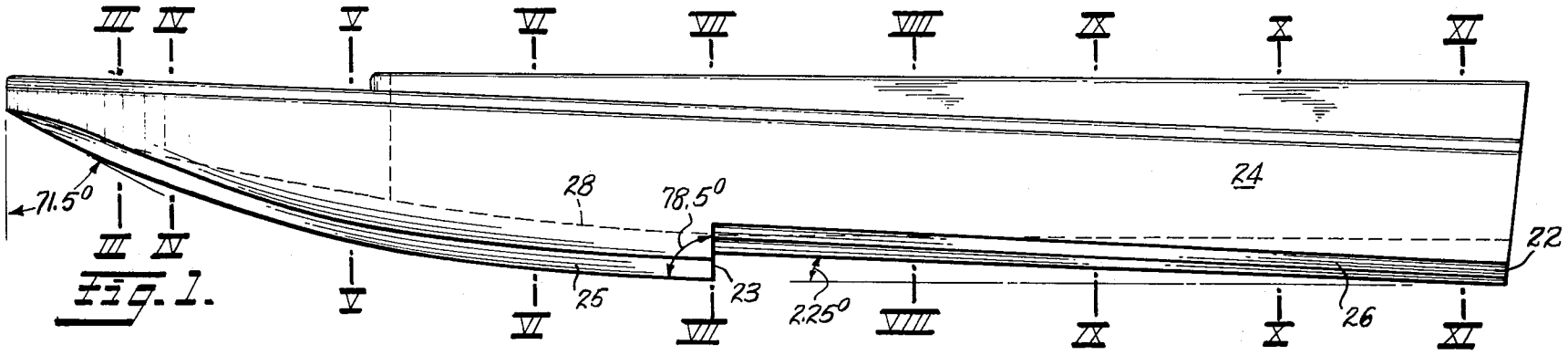
FIG. 1 is a port side view of my new hull.

Referring now to FIG. 1 it will be seen that each sponson comprises a forward part 21 and a stern part 22 which meet at a step 23.

As best seen in the transverse sectional views, the two sides 24 of the boat slope slightly inward and downward at an angle of about 10° to the perpendicular until they intersect the sponson bottoms 25, 26. In the case of the front sponsons these bottoms lie at an angle of less than 90° to the perpendicular, with their outer edges intersecting the boat sides and their inner edges intersecting the substantially vertical inner wall 27 of the sponson, which defines one outer wall of the tunnel, the bottom 28 of which is substantially straight and horizontal in section, but curves longitudinally as shown by the broken line in FIG. 1. The angle between the front sponson bottoms and the vertical changes gradually from about 71.5° at the bow to about 78.5° at the step.

The term "vertical" as used in the foregoing description refers to the vertical plane of symmetry extending longitudinally from bow to stern through the center of said hull.

The bottom of the rear part of each sponson comprises an outer section 29 and a wider inner section 30.

The angle between the outer section of the rear sponsons and the vertical changes from about 74° at the section line VIII—VIII to about 62.5° at the stern. The angle between the inner section of the rear sponsons and the vertical changes gradually from about 82° at the section line VIII—VIII to about 85° at the stern.

Figure 2:
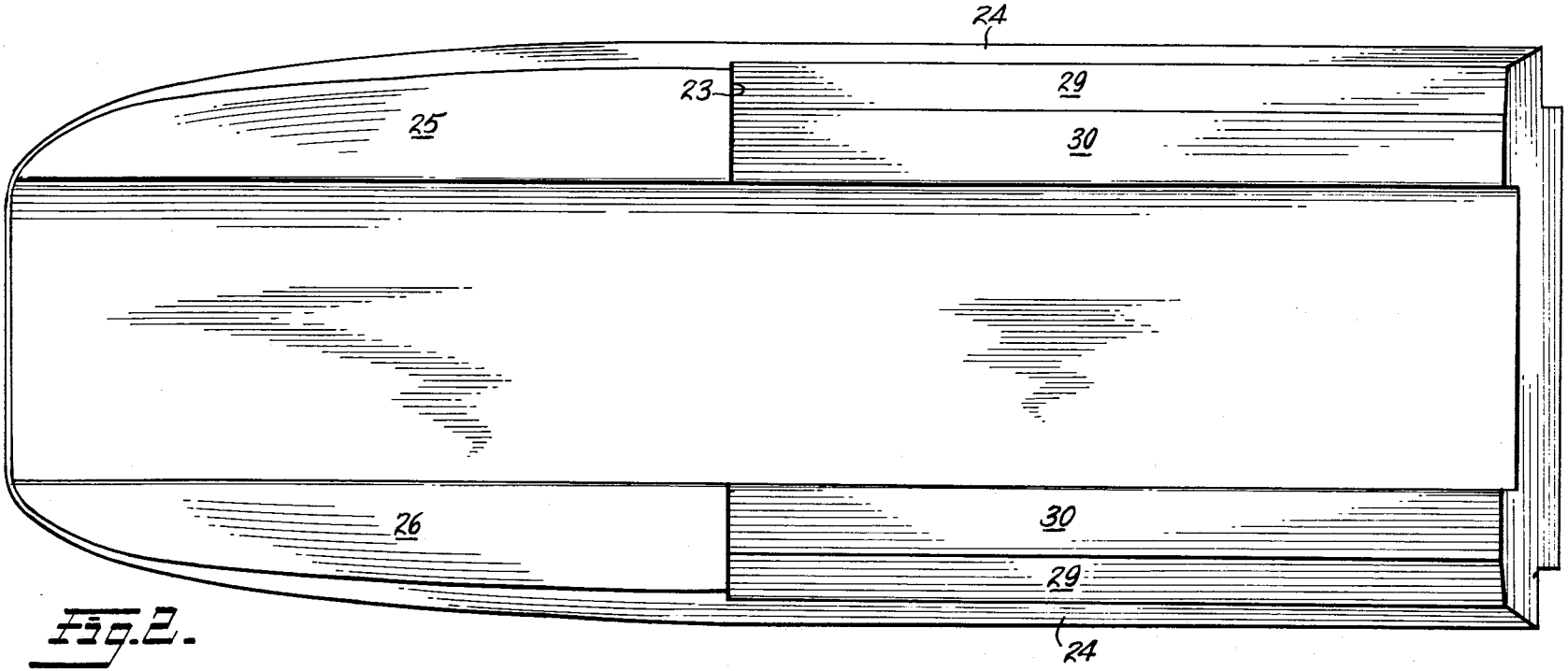
FIG. 2 is a bottom plan view of the starboard half of the hull.
Figure 3:
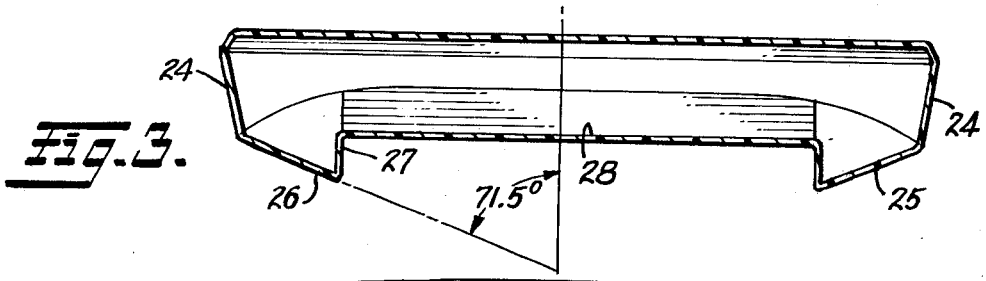
FIGS. 3-11 are schematic transverse sectional views taken along the lines III—III to XI—XI respectively.
Figure 4:
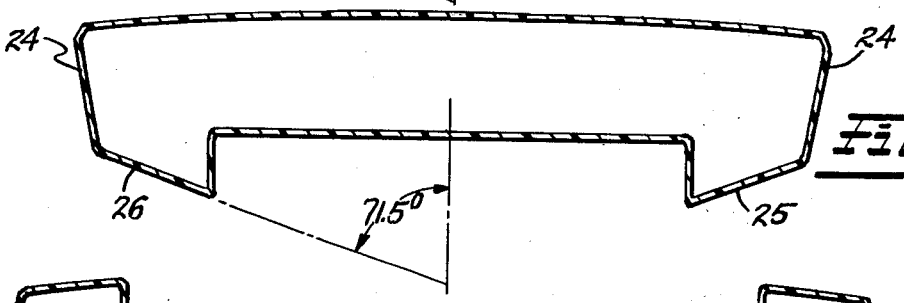
Figure 5:
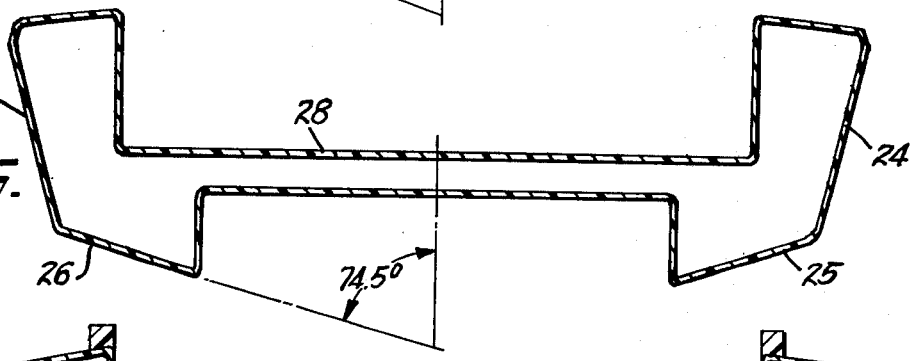
Figure 6:
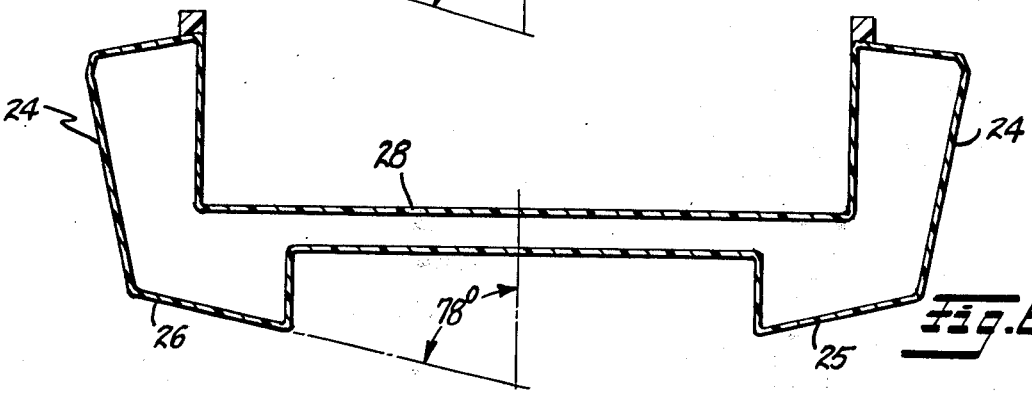
Figure 7:
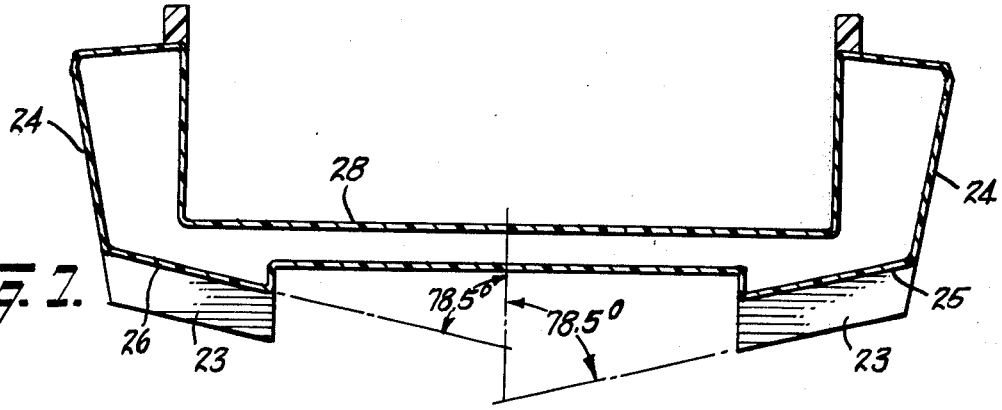
Figure 8:
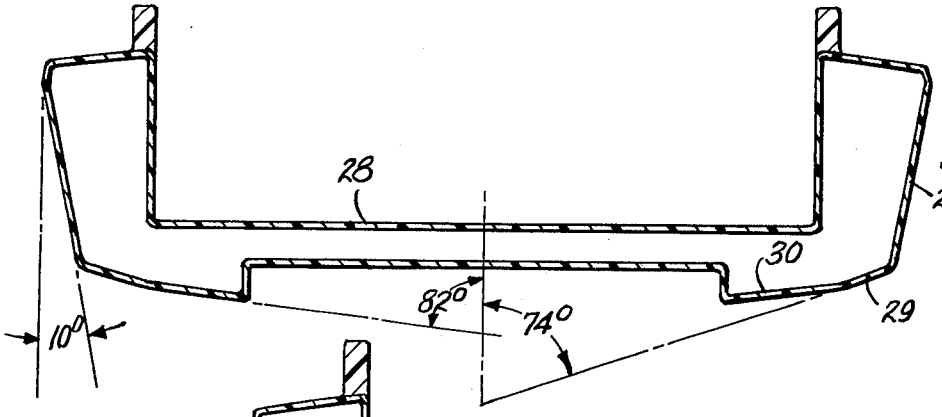
Figure 9:
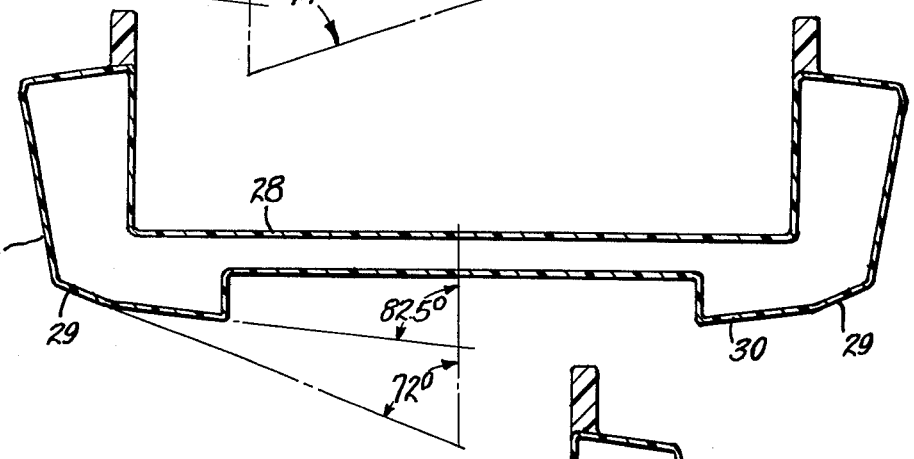
Figure 10:
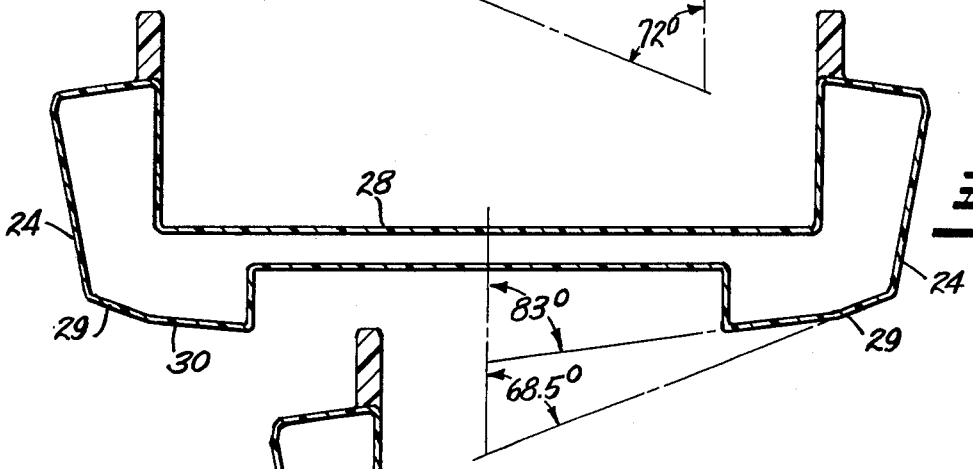
Figure 11:
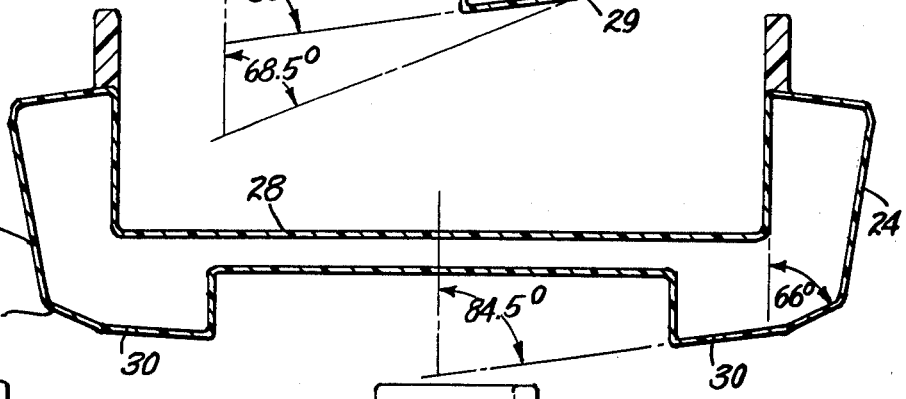
Figure 12:
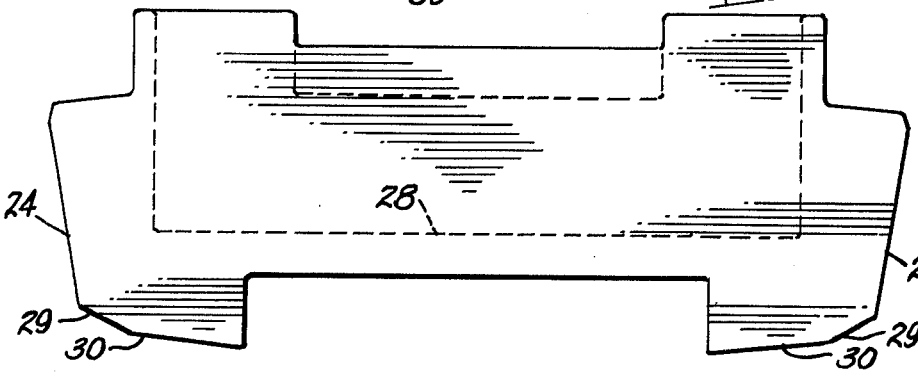
FIG. 12 is a rear elevational view of my new hull.

As best seen in FIG. 2 the bottom of the front part of each sponson, beginning at the bow, curves downwardly further and further below the bottom of the tunnel, until it reaches a first point of maximum depth below the tunnel bottom at the step 23, forwardly of the center of the boat. The bottom of the stern part of each sponson then slopes gradually further and further below the tunnel bottom until it reaches a second point of maximum depth below the tunnel bottom near the stern of the boat.

It will be noted that while the front part of each sponson slopes downwardly from bow to step more sharply than the rear part of each sponson from step to stern, the rear of each sponson part is at about the same distance below the tunnel bottom. It will also be noted that, while the bottom of the front portion of each sponson curves gradually from bow to step, the bottom of the rear part of each sponson follows a substantially straight line from step to stern. Furthermore, the depth of the step is such that the front end of the inner side of the rear part of each sponson extends about one-third as far below the bottom of the tunnel as the rear end of the inner side of the front part of each sponson.

While specific dimensions have been given so as to provide a complete description of a fully operative embodiment, skilled designers will appreciate that since this boat is designed to "plane" at normal operating speeds, the specific dimensions may be modified so long as the following criteria are observed:

1. Both the front and rear parts of the sponsons and tunnel must have a sufficient depth and bottom area to cause the tunnel bottom to rise and stay above the water at the operating speed.

2. The steps must cut deeply enough into the sponsons to permit the venting of air at those steps when the boat is planing.

3. The fact that the front and rear parts of the sponsons have the same maximum depth prevents the hull from running stern down as would be the case if the rear parts of the sponsons were inadequate in transverse area or depth.

What is claimed is:

1. In a boat hull of the type comprising two longitudinally extending, downwardly projecting sponsons having inner walls defining therebetween a longitudinal tunnel, said hull being designed to "plane" at a predetermined operating speed, the improvement according to which the lowermost surface of each sponson slopes upwardly and outwardly for at least the greater portion of its length and each sponson is interrupted forwardly of the center of said boat by a step extending in a direction having a vertical component and dividing said sponson into front and rear parts, with the bottom of the front part of each sponson lying at an angle of less than 90° with respect to the inner wall of the same sponson, and the entire bottom of the forward end of the rear part of each sponson substantially closer to the bottom of said tunnel than the lowermost portion of the rear end of the bottom of the front part of said sponson, while the rear ends of both the front and rear parts of said sponson lie at about the same distance below said tunnel bottom, said tunnel being free from any obstruction substantially inhibiting and said step being deep enough to permit transverse venting of the full width of said tunnel beneath either of the forward ends of the rear parts of said sponsons when said boat is planing.

2. A boat hull as claimed in claim 1 in which the bottom of the front part of each sponson lies at a smaller angle to a vertical plane of symmetry taken through the center of said hull than does the greater part of the bottom of the rear part of said sponson.

3. A boat hull as claimed in claim 2 in which the bottom of said front part of said sponson lies at an angle of from 71.5° to 78.5° to said vertical plane.

4. A boat hull as claimed in claim 3 in which the bottom of the rear part of each sponson is divided into inner and outer sections.

5. A boat hull as claimed in claim 4 in which said inner section is wider than said outer section and lies at an angle of from 82° to 85° to said vertical plane.

6. A boat as claimed in claim 5 in which said outer section lies at an angle of 74° to 62.5° to said vertical plane.

7. A boat as claimed in claim 3 in which the bottom of said tunnel is substantially flat between the step and the stern of said boat, but curves upwardly from said step to its bow.

8. A boat as claimed in claim 1 in which the lowest point on the front end of the rear part of each sponson is about one-third as far below said tunnel bottom as the lowest point on the rear end of the front part of each sponson.

9. A boat as claimed in claim 1 in which the bottom of the front part of each sponson is convex from bow to step, but the bottom of the rear part of each sponson is straight from step to stern.

* * * * *